US007080616B2

(12) United States Patent
Nakamura et al.

(10) Patent No.: US 7,080,616 B2
(45) Date of Patent: Jul. 25, 2006

(54) CYLINDER HEAD ASSEMBLY FOR AN INTERNAL COMBUSTION ENGINE WITH A CAMSHAFT POSITION SENSOR

(75) Inventors: Katsuyuki Nakamura, Yokohama (JP); Shigekazu Fuji, Yokohama (JP); Hiroshi Takano, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/960,026

(22) Filed: Oct. 8, 2004

(65) Prior Publication Data

US 2005/0076870 A1 Apr. 14, 2005

(30) Foreign Application Priority Data

Oct. 10, 2003 (JP) ..... 2003-351581

(51) Int. Cl.
*F01L 1/02* (2006.01)

(52) U.S. Cl. ..... 123/90.27; 123/90.16; 123/193.3; 123/195 C

(58) Field of Classification Search ..... 123/90.15, 123/90.16, 90.17, 90.18, 90.27, 90.31, 193.5, 123/193.3, 195 C; 73/116, 117.3
See application file for complete search history.

(56) References Cited

U.S. PATENT DOCUMENTS

| | | | |
|---|---|---|---|
| 6,148,787 A | 11/2000 | Takano | |
| 6,343,580 B1 | 2/2002 | Uchida | |
| 6,527,602 B1 * | 3/2003 | Tawa et al. | 440/77 |
| 6,679,107 B1 | 1/2004 | Ono et al. | |

FOREIGN PATENT DOCUMENTS

| | | | |
|---|---|---|---|
| EP | 0 458 341 | A1 | 11/1991 |
| EP | 0 698 728 | A1 | 2/1996 |
| EP | 1 156 191 | A1 | 11/2001 |
| JP | 59-10825 | A | 1/1984 |
| JP | 60-081409 | A | 5/1985 |
| JP | 02-067448 | A | 3/1990 |
| JP | 08-068346 | A | 3/1996 |
| JP | 09-013975 | A | 1/1997 |
| JP | 2001-329885 | A | 11/2001 |
| JP | 3431505 | B2 | 5/2003 |

* cited by examiner

*Primary Examiner*—Thomas Denion
*Assistant Examiner*—Ching Chang
(74) *Attorney, Agent, or Firm*—Foley & Lardner LLP

(57) ABSTRACT

A cylinder head assembly for an internal combustion engine houses a camshaft position sensor for determining an angular position of a camshaft. A cylinder head upper is disposed between a cylinder head and a cylinder head cover, covering a part of a top opening of the cylinder head. The cylinder head is softly mounted, while the cylinder head upper is rigidly mounted on the cylinder head. The cylinder head upper includes a sensor boss for the camshaft position sensor, so that the camshaft position sensor is facing downward toward a signal plate attached to the camshaft.

13 Claims, 4 Drawing Sheets

CYLINDER HEAD ASSEMBLY FOR AN INTERNAL COMBUSTION ENGINE WITH A CAMSHAFT POSITION SENSOR

BACKGROUND OF THE INVENTION

The present invention relates generally to cylinder head assemblies for internal combustion engines, and more particularly to a cylinder head assembly housing a camshaft position sensor to detect an angular position (a rotation angle) of a camshaft of an internal combustion engine.

Internal combustion engines generally include a camshaft position sensor to detect an angular position (a rotation angle) of a camshaft to open and close an intake valve or an exhaust valve. The camshaft position sensor senses a signal plate attached to a rear end portion of the associated camshaft. More specifically, located outward in a radial direction from the signal plate, the camshaft position sensor detects projections or grooves formed in the outer peripheral portion of the signal plate. In general, the camshaft position sensor is attached to a sensor boss formed in a cylinder head or a cylinder head cover covering a top opening of the cylinder head. Japanese Patent No. 3431505 shows such a structure in which the sensor boss for the camshaft position sensor is formed in a cylinder head.

SUMMARY OF THE INVENTION

In case the sensor boss is formed in the cylinder head, the camshaft position sensor is located on the side of or under the signal plate, since there is the cylinder head cover over the cylinder head. Accordingly, the camshaft position sensor is attached from below to the sensor boss, with a sensing section oriented upwardly or horizontally toward the signal plate. This may tend to cause accumulation of substance such as dust particles and lubricating oil, to cause pollution or a breakdown of the camshaft position sensor.

In case the sensor boss is formed in the cylinder head cover, the camshaft position sensor may be located outward in a vertical direction over the signal plate. This structure causes no trouble as previously discussed. This structure, however, needs a rigid mount of the cylinder head cover to the cylinder head, to retain the geometrical relationship between the camshaft position sensor and the signal plate. For example, the cylinder head cover is formed of die-casting aluminum to provide a sturdy and solid attachment structure. This structure has a disadvantage in weight and cost with reference to a structure where the cylinder head cover is formed of a resin and is mounted by a soft mount structure such as a full floating structure and a semi floating structure.

It is an object of the present invention to provide a cylinder head assembly for an internal combustion engine with a camshaft position sensor for mounting the camshaft position sensor on the cover portion thereof and for softly mounting a cylinder head cover formed of a resin with respect to a cylinder head.

According to one aspect of the present invention, a cylinder head assembly for an internal combustion engine with a camshaft position sensor, comprises a cylinder head including a top opening, a camshaft rotatably supported by the cylinder head and including a sensing target to be sensed to determine an angular position of the camshaft by the camshaft position sensor, a cylinder head upper covering a part of the top opening of the cylinder head over the sensing target, a cylinder head cover covering the remaining part of the top opening of the cylinder head, and the cylinder head upper including a sensor boss to support the camshaft position sensor.

According to another aspect of the invention, a cylinder head assembly for an internal combustion engine with a camshaft position sensor, comprises a cylinder head including a top opening, a camshaft rotatably supported by the cylinder head and including a sensing target to be sensed to determine an angular position of the camshaft by the camshaft position sensor, first covering means for covering a part of the top opening of the cylinder head over the sensing target, second covering means for covering the remaining part of the top opening of the cylinder head, and the first covering means including a sensor support means for supporting the camshaft position sensor.

DETAILED DESCRIPTION OF THE INVENTION

Figure 1:
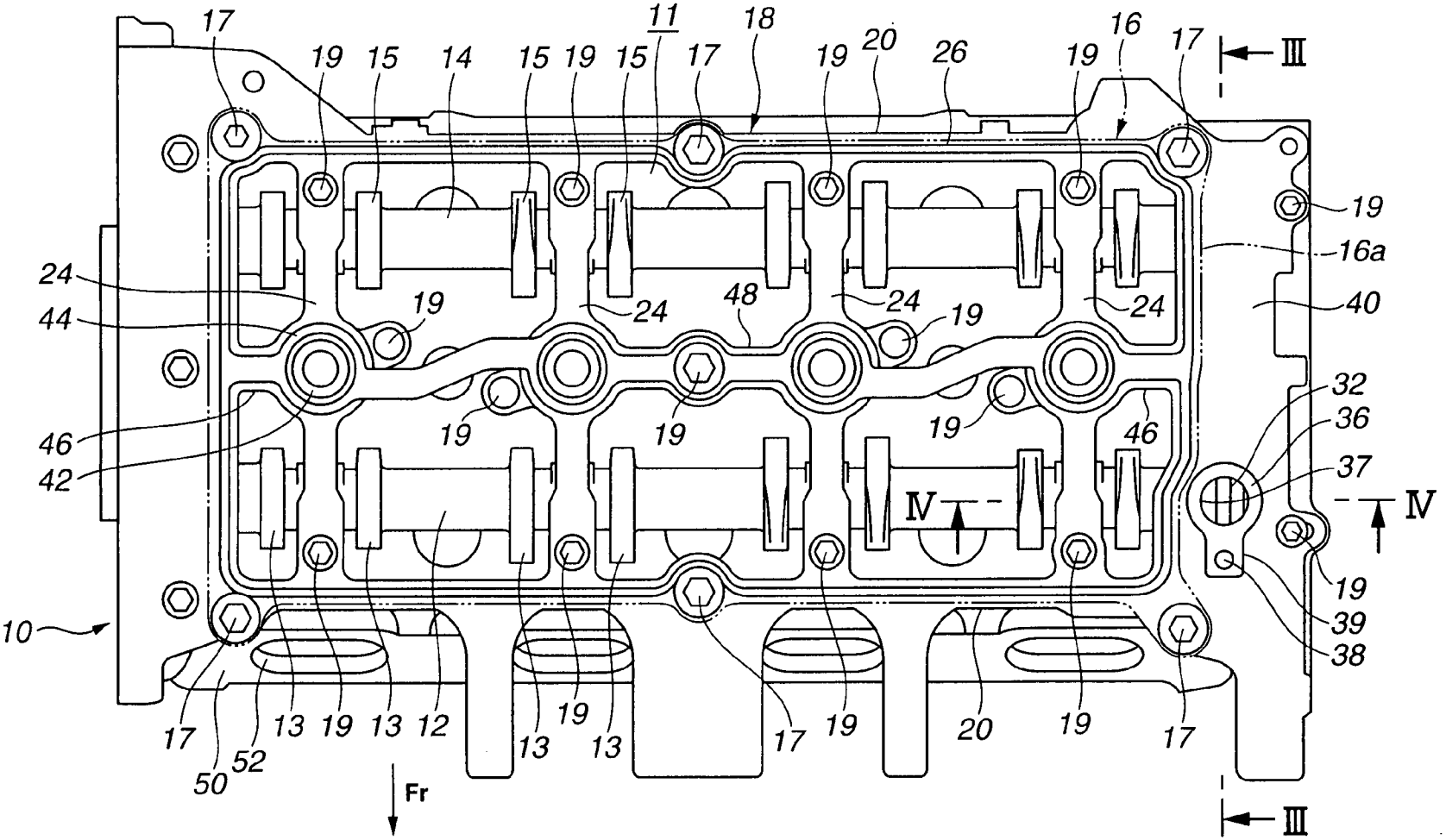
FIG. 1 is a top view of an internal combustion engine with a cylinder head cover dismounted, in accordance with an embodiment of the present invention.

Referring now to FIGS. 1 to 4, there is shown a cylinder head assembly for an internal combustion engine with a camshaft position sensor in accordance with an embodiment of the present invention.

In this embodiment, an in-line four-cylinder internal combustion engine is employed. The engine is mounted in the lateral direction in the engine room of a vehicle, with an intake side facing the front of the vehicle Fr (toward the bottom in FIG. 1), to promote rapid activation of a catalyst. With the engine mounted in the vehicle body, the top-to-bottom direction of the engine is substantially same as the vertical direction. The following description of the embodiment uses a general coordinate system. That is, "top" and "bottom" are generally defined with respect to an axis along the line connecting the top and bottom of the cylinder of the engine ("top" is on the top in FIG. 2). Similarly, "front" and "rear" are generally defined with respect to an axis along the line connecting the front end and the rear end of the engine, or along the shafts ("front" is on the left in FIG. 1).

Formed of an aluminum alloy, cylinder head 10 includes a top opening 11 at its top portion. In the upper portion of cylinder head 10 are disposed an intake camshaft 12 and an exhaust camshaft 14. Rotatably supported by cylinder head 10, intake camshaft 12 includes a plurality of intake cam lobes 13 for opening and closing intake valves. Similarly, rotatably supported by cylinder head 10, exhaust camshaft 14 includes a plurality of exhaust cam lobes 15 for opening and closing exhaust valves. Extending along the array of cylinders (in the lateral direction in FIG. 1) in parallel to each other, camshafts 12, 14 have front ends to which camshaft sprockets are attached. The camshaft sprockets are associated with a crankshaft sprocket for a crankshaft via a timing chain, so that camshafts 12, 14 rotate in relation to the crankshaft. This connection may include a variable valve timing mechanism with which the angular position of the camshaft can be varied with the angular position of the crankshaft.

Figure 2:
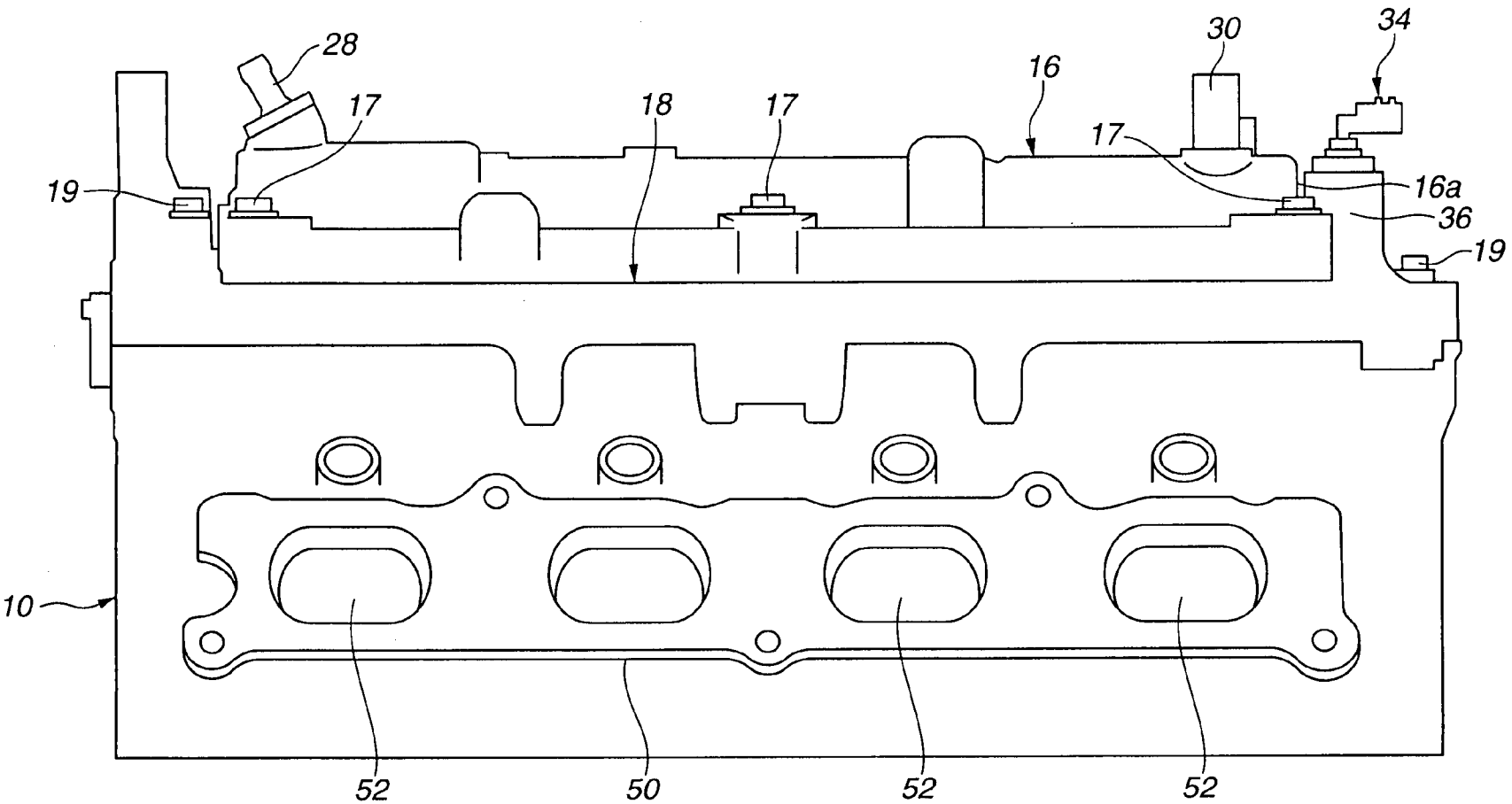
FIG. 2 is a side view of the internal combustion engine of FIG. 1.

Between cylinder head 10 and a cylinder head cover (also called a rocker cover or a cam cover) 16 are disposed a cylinder head upper 18. Cylinder head upper 18 is formed of a metal such as an aluminum alloy and cast iron to have a rigidity or a strength comparable to cylinder head 10. Cylinder head upper 18 is fixed on the upper face of cylinder head 10 by a plurality of cylinder head upper mounting bolts 19. In other words, layered upon cylinder head 10, cylinder head upper 18 serves for the upper end portion of cylinder head 10. A front cover (not shown) is attached to the front faces of cylinder head 10 and cylinder head upper 18. As shown in FIGS. 1 and 2, an intake manifold flange 50 is formed on the left side face of cylinder head 10, to mount an intake manifold. Intake manifold flange 50 includes four intake ports 52.

As shown in FIG. 1, cylinder head upper 18 includes an outer frame 20 and a plurality of upper bearing portions 24. Outer frame 20 is formed into a rectangular shape, to be fitted with top opening 11 of cylinder head 10 which is defined by the front wall, the rear wall, a pair of side walls of cylinder head 10. Upper bearing portion 24 and a lower bearing portion 22 formed in cylinder head 10 are coupled to support camshafts 12, 14 for rotation. Each of upper bearing portions 24 is bridged between the side frames of outer frame 20 and arranged evenly spaced in the longitudinal direction of the engine. In this manner, cylinder head upper 18 has a ladder frame structure as a whole which is suitable for constructing a strong and rigid structure. In detail, two of upper bearing portions 24 near the front end or the rear end of the engine are connected with the frames of outer frame 20 via side beams 46, and two of upper bearing portions 24 at the center are connected with each other via a center beam 48, to strengthen the structure of cylinder head upper 18.

As discussed above, upper bearing portions 24 supporting camshafts 12, 14 are formed integrally with cylinder head upper 18. This results in a small number of parts, and in an easy or simple assembling operation. In addition, cylinder head upper 18 has a ladder frame structure, to provide a preferable support rigidity as a cam bracket.

Cylinder head cover 16 is integrally molded from a synthetic resin which is generally lighter and more inexpensive than a metal material. Cylinder head cover 16 is mounted on the upper face of cylinder head upper 18 via a gasket 26 by a plurality of bolts 17. Cylinder head cover 16 includes a PCV valve 28, and a fresh air intake port 30, as shown in FIG. 2, and houses components such as an oil mist separator (not shown). Cylinder head cover 16 is mounted by a soft mount structure such as a full floating and a semi floating structure to reduce noise or vibration. Gasket 26 extends through the periphery of cylinder head cover 16, and a peripheral portion 44 around an ignition plug boss 42.

Figure 3:
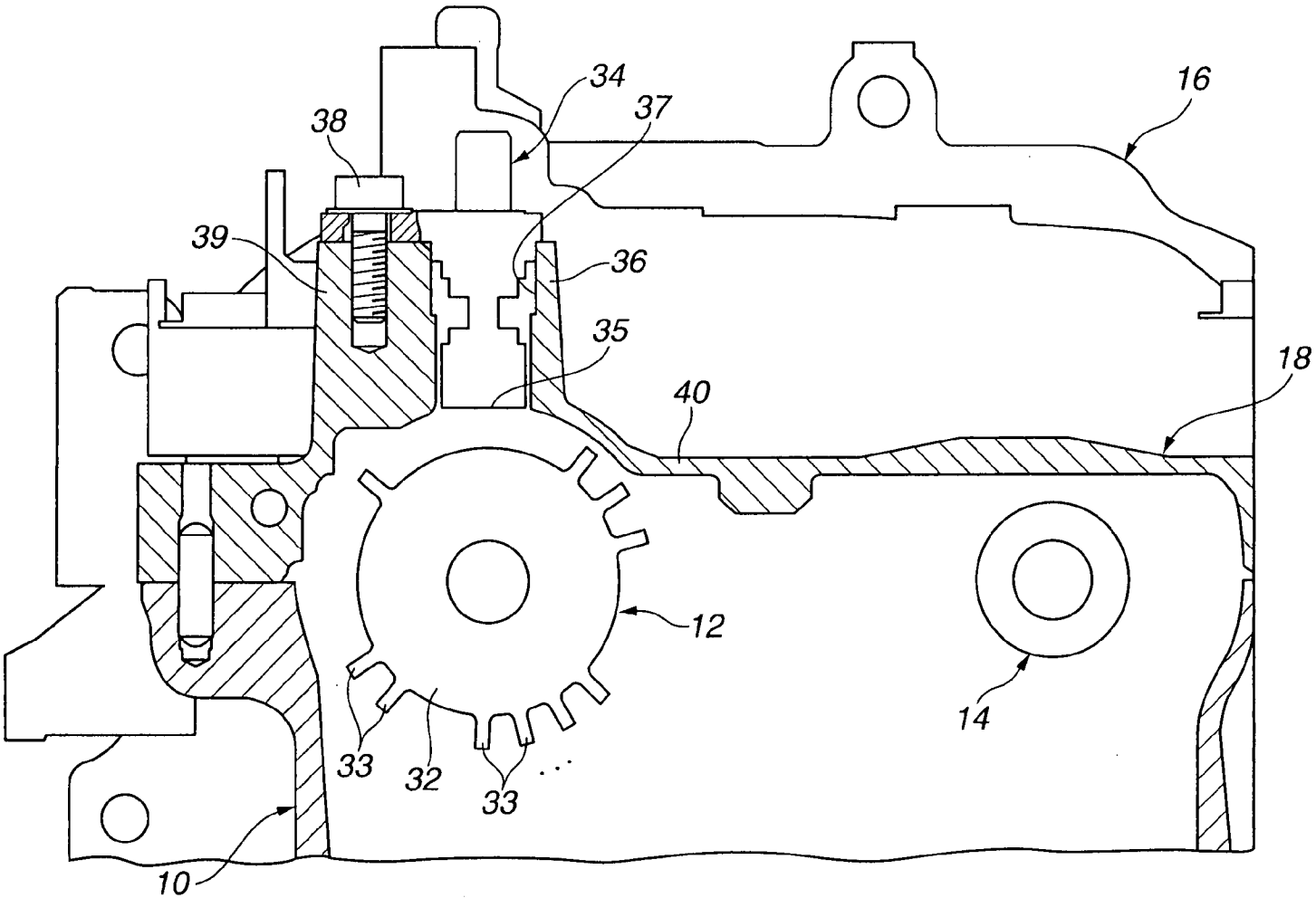
FIG. 3 is a cross sectional view taken along the plane indicated by the line III—III in FIG. 1.
Figure 4:
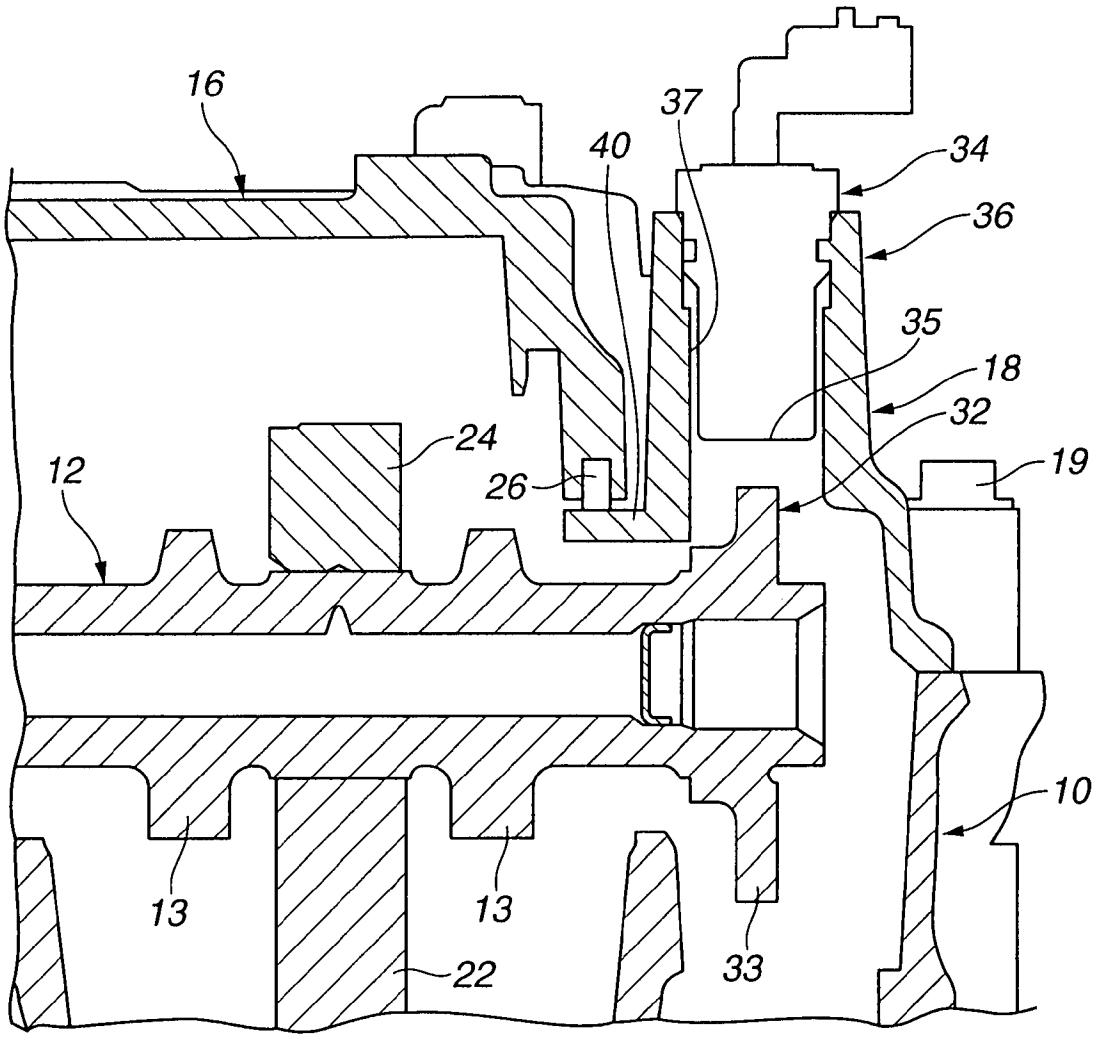
FIG. 4 is a side sectional view taken along the plane indicated by the line IV—IV in FIG. 1.

As shown in FIGS. 3 and 4, at the rear end of intake camshaft 12 is mounted a signal plate 32 as a sensing target to be sensed to determine an angular position of intake camshaft 12. Signal plate 32 includes a plurality of signal projections or teeth 33 radially extending around its peripheral portion. Signal projections 33 are configured at predetermined intervals to indicate the angular position of signal plate 32 or intake camshaft 12. In cylinder head upper 18 is mounted a camshaft position sensor 34 to detect the angular position of intake camshaft 12. Based on the signals from camshaft position sensor 34 and a crank angle sensor (not shown) to detect the crank angle of the crankshaft or the engine speed, the timing of fuel injection and the timing of ignition for each cylinder are controlled. Camshaft position sensor 34, which is, for example, a phase sensor, detects the angular position of intake camshaft 12 by sensing signal projections 33 of signal plate 32 with a sensing section 35 at its tip.

Cylinder head upper 18 includes a sensor boss 36 to support camshaft position sensor 34. Sensor boss 36 is integrally formed in a cover portion 40 of cylinder head upper 18 that extends horizontally at the rear end portion of cylinder head upper 18, formed into a cylindrical shape extending upwardly from cover portion 40. Sensor boss 36 includes a portion defining a sensor hole 37 extending in the top-to-bottom direction of the engine to engage with camshaft position sensor 34. In this structure, with camshaft position sensor 34 dismounted, signal plate 32 is visible via sensor hole 37 in the top view, as shown in FIG. 1.

Cover portion 40 of cylinder head upper 18 extends forward and horizontally from its portion coupled with the rear end of cylinder head 10, formed into a substantially flat plate normal to the longitudinal axis of the cylinders. Cylinder head cover 16 has a rear end 16*a* fixed to cover portion 40 of cylinder head upper 18 at a longitudinal location in front of sensor boss 36. In other words, cylinder head cover 16 is shortened by the longitudinal length of cover portion 40. The remaining area of top opening 11 of cylinder head 10 which is produced by shortening cylinder head cover 16 is covered by cover portion 40 in which sensor boss 36 is formed. Thus, cover portion 40 of cylinder head upper 18 serves for covering the rear end portion of top opening 11 of cylinder head 10. Accordingly, cylinder head upper 18 rigidly mounted on cylinder head 10 includes cover portion 40 covering a part of top opening 11 of cylinder head 10 over signal plate 32, and cylinder head cover 16 covers the remaining part of top opening 11 of cylinder head 10.

Camshaft position sensor 34 is inserted downwardly into and is engaged with sensor hole 37. Camshaft position sensor 34 is fixed by a sensor mounting bolt 38 to bolt boss 39 formed on the side of sensor boss 36. Accordingly, mounted on the engine, the longitudinal axis of camshaft position sensor 34 and the rotational axis of signal plate 32 are orthogonal to each other in a same plane. Camshaft position sensor 34 is located outward in the radial direction of signal plate 32 or intake camshaft 12. Mounted in sensor boss 36, camshaft position sensor 34 includes sensing section 35 facing downward to signal plate 32. In this manner, cylinder head upper 18 as an integral cam bracket includes cover portion 40 covering a part of top opening 11 of cylinder head 10, and cover portion 40 includes a portion defining sensor boss 36. Sensor boss 36 is located at a portion of cylinder head upper 18 accessible from outside in a state where the cylinder head assembly is assembled.

The following describes effects produced by the cylinder head assembly in accordance with the embodiment of the present invention. Sensor boss 36 is located outward in a radial direction of intake camshaft 12 with respect to signal plate 32, being out of cylinder head cover 16, which results in lowering the overall height of the engine since camshaft position sensor 34 is mounted standing on the side of cylinder head cover 16 accommodating components such as an oil mist separator. This allows a flexible layout of the engine. Camshaft position sensor 34 is attached from above and mounted in sensor boss 36 with sensing section 35 facing downwardly, resulting in easing operations of attachment and maintenance of camshaft position sensor 34 and avoiding the entry or the accumulation of substances to prevent a damage or breakdown of camshaft position sensor 34. Without including sensor boss 36, cylinder head cover 16 may be formed of a light and inexpensive resin, and be mounted by soft mount structure such as a full floating structure and a semi floating structure.

Cylinder head upper 18 has a ladder frame structure including outer frame 20 and a plurality of upper bearing portions 24. This structure has an advantage in strength and rigidity so as to provide a preferable bearing rotatably supporting a camshaft. In addition, this structure eases and simplifies assembly of the engine, since upper bearing portion 24 is integrally formed with cylinder head upper 18.

In the shown embodiment, the signal plate and the sensor boss are located at the rear end portion of the engine. Alternatively, the signal plate and the sensor boss may be located at the front end portion of the engine.

In the shown embodiment, the cylinder head upper is formed to fit the whole outer peripheral portion of the top opening of the cylinder head. The cylinder head cover is softly mounted on the cylinder head upper. Alternatively, the upper cylinder may be downsized so that a part or the whole of the cylinder head cover is softly mounted directly on the cylinder head.

This application is based on a prior Japanese Patent Application No. 2003-351581 filed on Oct. 10, 2003. The entire contents of this Japanese Patent Applications No. 2003-351581 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A cylinder head assembly for an internal combustion engine with a camshaft position sensor, comprising:

a cylinder head including a top opening;

a camshaft rotatably supported by the cylinder head and including a sensing target to be sensed to determine an angular position of the camshaft by the camshaft position sensor;

a cylinder head upper including a cover portion sealingly covering a rear end part of the top opening of the cylinder head over the sensing target, the cover portion extending from a left end of the top opening to a right end of the top opening; and a cylinder head cover covering the remaining front part of the top opening of the cylinder head and including a rear end arranged on a front side of the cover portion of the cylinder head upper, wherein the cylinder head upper includes a sensor boss to support the camshaft position sensor.

2. The cylinder head assembly as claimed in claim 1, wherein the cylinder head upper is rigidly mounted on the cylinder head; and the cylinder head cover is softly mounted on at least one of the cylinder head upper and the cylinder head.

3. The cylinder head assembly as claimed in claim 2, wherein the sensor boss is located outward in a radial direction of the camshaft with respect to the sensing target.

4. The cylinder head assembly as claimed in claim 2, wherein the sensor boss is located at a portion of the cylinder head upper accessible from outside in a state where the cylinder head assembly is assembled.

5. The cylinder head assembly as claimed in claim 2, wherein the sensor boss is configured to let the camshaft position sensor attached from above.

6. The cylinder head assembly as claimed in claim 2, wherein the camshaft position sensor includes a sensing section facing downward to the sensing target.

7. The cylinder head assembly as claimed in claim 2, wherein the cylinder head upper comprises:

an outer frame fitted with the whole outer peripheral portion of the top opening of the cylinder head; and an upper bearing portion bridged between side frames of the outer frame, to rotatably support the camshaft in cooperation with the cylinder head.

8. The cylinder head assembly as claimed in claim 2, wherein the cylinder head upper is formed of a metal; and the cylinder head cover is formed of a resin.

9. The cylinder head assembly as claimed in claim 2, further comprising a gasket, wherein the cylinder head cover is softly mounted on the cylinder head upper via the gasket.

10. The cylinder head assembly as claimed in claim 2, further comprising a gasket, wherein the cylinder head cover is softly mounted on the cylinder head via the gasket.

11. The cylinder head assembly as claimed in claim 2, wherein the sensor boss is fonned in the cover portion; and the cylinder head cover includes a rear end attached to the cover portion on a front side of the sensor boss.

12. A cylinder head assembly for an internal combustion engine with a camshaft position sensor, comprising:

a cylinder head including a top opening;

a camshaft rotatably supported by the cylinder head and including a sensing target to be sensed to determine an angular position of the camshaft by the camshaft position sensor;

first covering means including a cover portion for sealingly covering a rear end part of the top opening of the cylinder head over the sensing target, the cover portion extending from a left end of the top opening to a right end of the top opening; and second covering means for covering the remaining part of the top opening of the cylinder head, and including a rear end arranged on a front side of the cover portion of the first covering means, wherein the first covering means includes a sensor support means for supporting the camshaft position sensor.

13. A cylinder head assembly for an internal combustion engine with a camshaft position sensor comprising:

a cylinder head including a top opening;

a camshaft rotatably supported by the cylinder head and including a sensing target to be sensed to determine an angular position of the camshaft by the camshaft position sensor;

a cylinder head upper covering a part of the top opening of the cylinder head over the sensing target;

a cylinder head cover covering the remaining part of the top opening of the cylinder head, the cylinder head upper including a sensor boss to support the camshaft position sensor, wherein the cylinder head upper comprises:

an outer frame fitted with the whole outer peripheral portion of the top opening of the cylinder head; and an upper bearing portion bridged between side frames of the outer frame, to rotatably support the camshaft in cooperation with the cylinder head.

* * * * *